United States Patent [19]

Almén

[11] 4,107,394

[45] Aug. 15, 1978

[54] CORRUGATED SHEET METAL HEAT TRANSFER MEMBER

[75] Inventor: Rune Almén, Halmstad, Sweden

[73] Assignee: Sensotherm AB, Sandviken, Sweden

[21] Appl. No.: 650,952

[22] Filed: Jan. 21, 1976

[30] Foreign Application Priority Data

Feb. 4, 1975 [SE] Sweden ..... 7501204

[51] Int. Cl.[2] ..... F28F 1/12

[52] U.S. Cl. ..... 428/595; 29/157.3 R; 113/1 R; 113/1 C; 165/173; 428/597

[58] Field of Search ..... 113/118 R, 118 C, 1 C; 29/157.3 R; 165/173; 428/603, 597, 593, 598, 604, 595

[56] References Cited

U.S. PATENT DOCUMENTS

| | | | |
|---|---|---|---|
| 2,977,918 | 4/1961 | Kritzer | 29/157.3 R |
| 3,490,524 | 1/1968 | Pasternak | 113/118 R |
| 3,922,768 | 12/1975 | Takayasu | 29/157.3 R |

*Primary Examiner*—Arthur J. Steiner
*Attorney, Agent, or Firm*—Karl W. Flocks

[57] ABSTRACT

In a corrugated metal sheet of the type that is adapted to have the edges of recesses which are located at the crests of the corrugations engaging a tube for establishing heat transmitting contact between the metal sheet and the tube, each recess in the metal sheet is so much smaller than the geometrical figure inscribed by the line of engagement between the metal sheet and the tube that an annular edge portion will be formed between the recess and the line of engagement. As a result, the recess despite manufacturing inaccuracies will bear with the whole extent of its edges against the tube, the excess material at the edges of the recess being brought to form an edge flange facing the tube.

The corrugated metal sheet is manufactured from a strip which is advanced stepwise in the corrugating operation. The recesses are punched in the metal sheet before the corrugating operation, the punching being effected between the steps of advancing the metal sheet. The corrugations are also given their final shape between the steps of advancing the metal sheet. Between the steps of advancing the metal sheet, the excess material at the edges of the recess in a finished corrugation is shaped into the edge flange which is to engage the tube.

3 Claims, 14 Drawing Figures

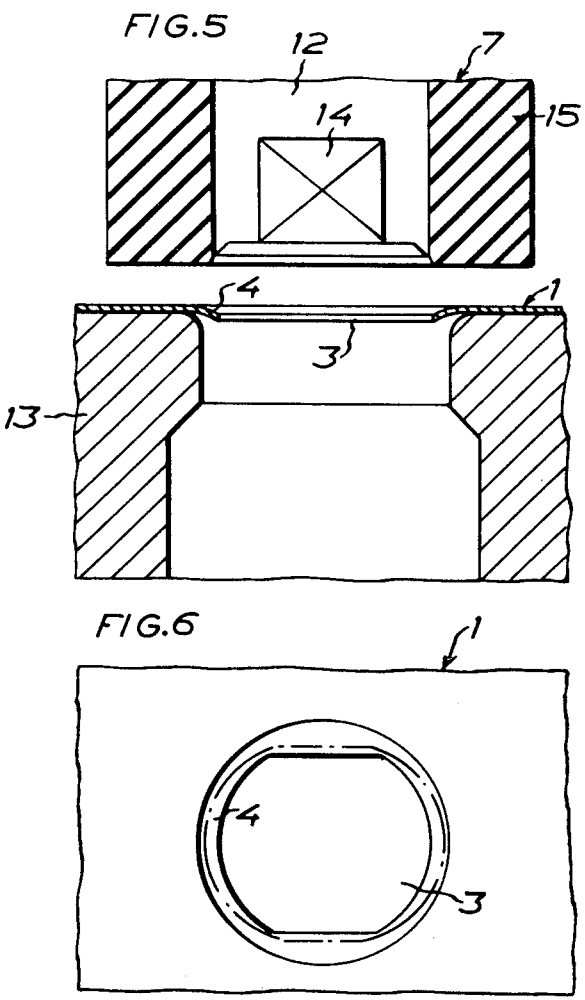
FIG.5
FIG.6
7
15
12
14
1
3
4
13
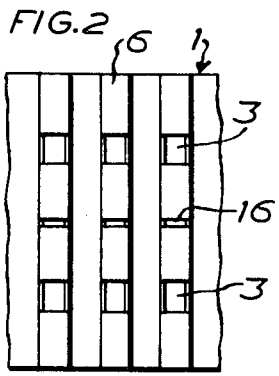
FIG.2
1
6
3
16
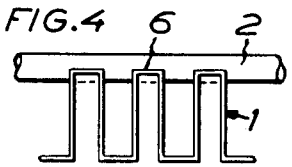
FIG.4
2
1
6
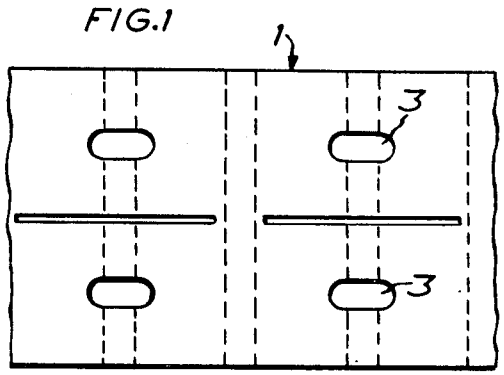
FIG.1
1
3
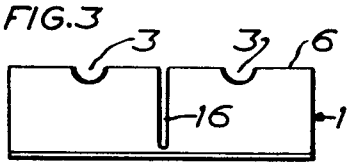
FIG.3
1
6
3
16
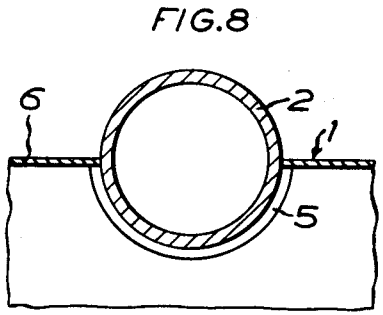
FIG.8
1
2
5
6
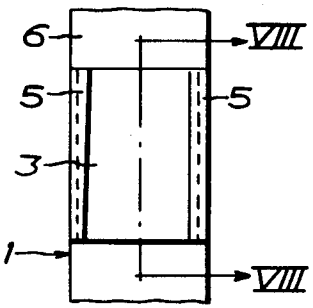
FIG.7
VIII
VIII
5
6
5
3
1

CORRUGATED SHEET METAL HEAT TRANSFER MEMBER

This invention relates to a corrugated metal sheet of the type that is adapted to have the edges of recesses which are located at the crests of the corrugations engaging a tube preferably for establishing heat transmitting contact between the metal sheet and the tube. Characteristic of the invention is that each recess in the metal sheet is so much smaller than the geometrical figure inscribed by the line of engagement between the metal sheet and the tube that an annular edge portion will be formed between the recess and the line of engagement and the recess will bear with the whole extent of its edges against the tube, whereby the excess material at the edges of the recess is brought to form an edge flange facing the tube. As a result, a good heat transmitting contact is ensured between the metal sheet and the tube since manufacturing inaccuracies will be compensated for by the edge flange whose width may vary along the edge of the recess without unfavourably influencing the heat transmission.

The corrugated metal sheet according to the invention is well suited for series production with relatively simple means, as no great precision is required in its manufacture. Therefore, the invention also relates to a method of producing the corrugated metal sheet which comprises advancing the metal sheet in the form of a strip, band or like configuration in conjunction with the corrugating operation, punching recesses in the metal sheet prior to the corrugating operation and between the steps of advancing the metal sheet, finishing the corrugations between the steps of advancing the metal sheet, and shaping the excess material at the edges of the recesses in finished corrugations likewise between the steps of advancing the metal sheet into the edge flange which is to engage the tube.

Embodiments of the invention will be more fully described hereinbelow with reference to the accompanying drawings in which FIG. 1 is a developed plan view of the metal sheet in which the recesses and bending lines are indicated by dotted lines;

FIG. 2 is a top plan view of the corrugated metal sheet;

FIG. 3 is a front view of the metal sheet;

FIG. 4 is a side view of the metal sheet associated with a tube;

FIG. 5 is a cross-section of a sheet metal punching tool and a metal sheet to be punched therein;

FIG. 6 is a top plan view of the punched metal sheet;

FIG. 7 is a view, on a larger scale, of the area surrounding a recess according to FIG. 2;

FIG. 8 is a section, on line VIII—VIII in FIG. 7, of a metal sheet and a tube associated therewith;

Figure 9:
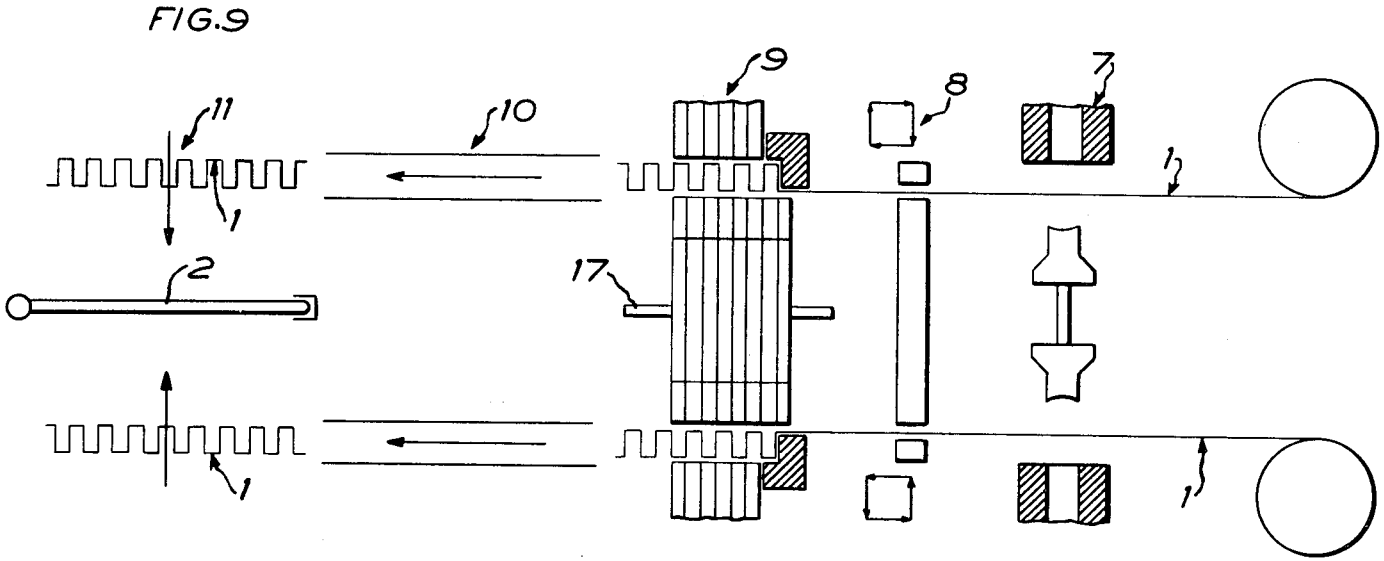
FIG. 9 is a diagrammatic view of a machine which produces two corrugated metal sheets at a time for simultaneous mounting in a common tube system.
Figure 14:
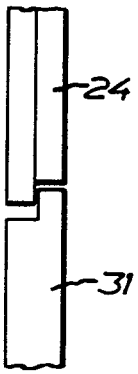

FIGS. 10–13 on a larger scale show one of the corrugating units in FIG. 9 in four successive working positions;

FIG. 14 shows a detail of the corrugating unit in a special position.

The corrugated metal sheet 1 is primarily intended to form the secondary element of a space heater which includes a tube system 2 oriented in a vertical plane, through which system flows a heat emitting liquid such as water. The secondary elements which are in good heat transmitting contact with the tube system will form vertical air channels by reason of the corrugated metal sheet 1. Apart from the tube system 2 and the secondary elements 1 the room heater normally also includes a front sheet spaced from the secondary elements 1. However, the corrugated metal sheet 1 can also be used in other cases where a good contact between the metal sheet 1 and the tube 2 is required.

As will appear from FIG. 1 the metal sheet 1 which is formed by a strip, band or like means is provided at regular intervals with two adjacent recesses 3 which are to cooperate with two adjacent tubes 2.

As will best be seen from FIGS. 6–8, the recess 3 in the metal sheet 1 is smaller than the geometrical figure inscribed by the line of engagement (indicated by dotted lines) between the metal sheet 1 and the tube 2. It will be realized that there is excess material along the entire annular edge of the recess 3, said material forming an edge flange 5 facing the tube 2. From the point of view of heat conduction said edge flange need not be symmetrically disposed in relation to the tube. The left flange 5 in FIG. 7 is meant to illustrate this.

As will best be seen from FIG. 4, the sides of the corrugations are plane parallel, the crests 6 of the corrugations being at right angles to the sides and planar. Said corrugation crests 6 are also at right angles to the direction of the tube 2. In this case each recess 3 in the metal sheet 1 in the developed state thereof is of essentially oval shape with the major axis oriented in the direction of the tube 2. The oval shape is preferably modified in such a way that the opposed sides of the recess 3 are parallel, to the extent they correspond to the planar corrugation crest 6.

The machine shown in FIG. 9 comprises the punching tool 7, the advancing device 8, the corrugating means 9, the conveyors 10 and the riveting machine 11. The punching tool 7 is of the construction more fully shown in FIG. 5. The tool 7 thus comprises the plunger 12 and the die 13. The plunger is provided with a pair of plane-parallel surfaces 14 which correspond to the opposed parallel sides of the substantially oval recess 3. A hold-down device 15 of preferably elastic material is disposed around the plunger 12, and as the edges of the hole in the die 13 are slightly rounded the hold-down device will subject the excess material which is to form the edge flange 5 to a preliminary bending operation facilitating the shaping of said edge flange.

The machine is equipped with two punching tools 7 which are disposed in lateral relationship and adapted to produce laterally spaced rows of recesses 3. A further punching tool is disposed between the afore-mentioned two punching tools 7 to cut a slit 16 between each pair of recesses 3. Said slit 16 imparts a turbulent motion to the air flowing through the vertical air channels, thus improving the heat transmission.

The sheet metal advancing device 8 which operates stepwise or intermittently is provided between the punching tool 7 and the corrugating means 9 and is common to said two units.

The corrugating means 9 includes a number of mandrels actuated by cams on cam shafts 17; these mandrels contribute to shaping the corrugations and finishing the corrugations and to shaping the excess material at the edges of the recess 3 in a finished corrugation into the edge flange 5 which is to engage the tube 2.

With the orientation of the corrugating means 9 illustrated in FIGS. 10–13 the mandrels 21, 22, 23 and 24 on the upper side and the mandrels 25 and 26 on the lower side are movable. This has been elucidated by means of arrows in FIG. 10. The details designated 27–31 are stationary.

Figure 10:
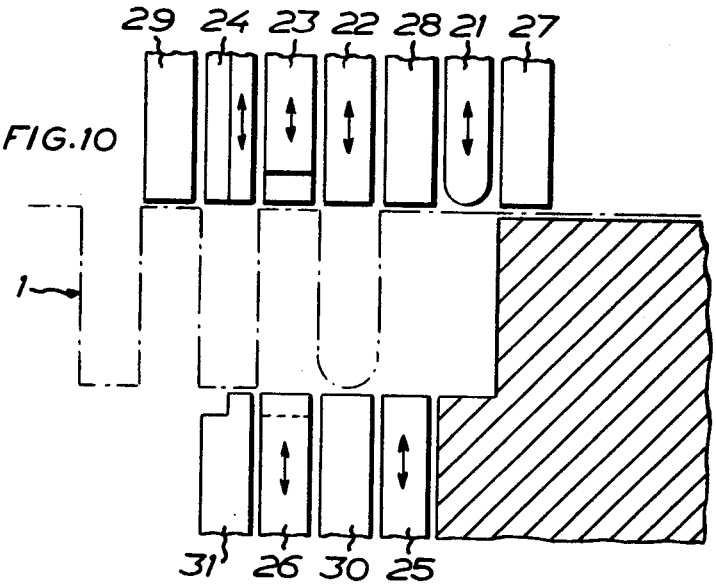
Figure 11:
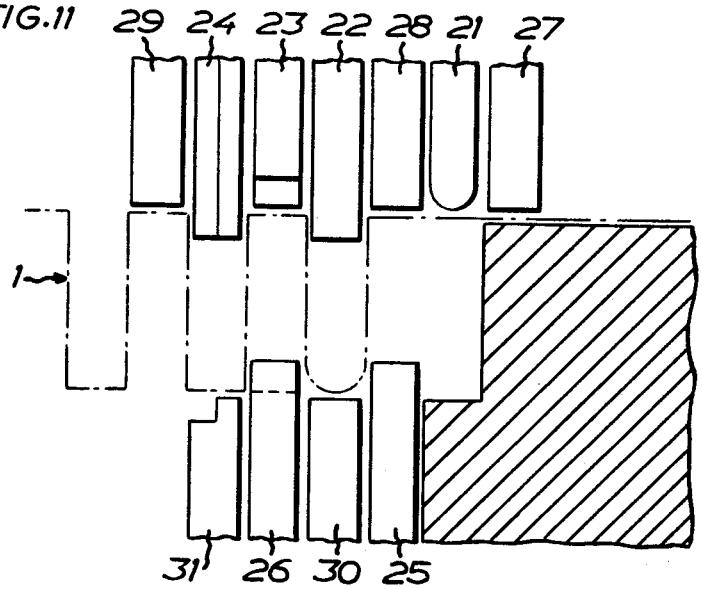
Figure 12:
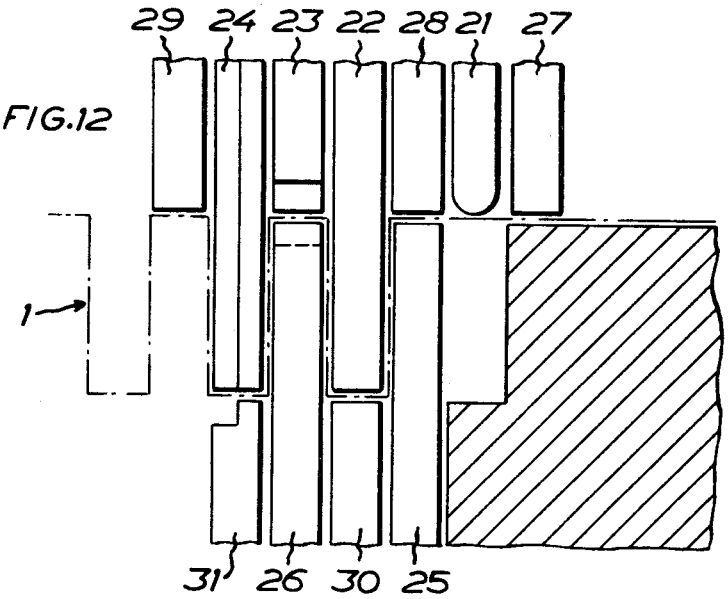
Figure 13:
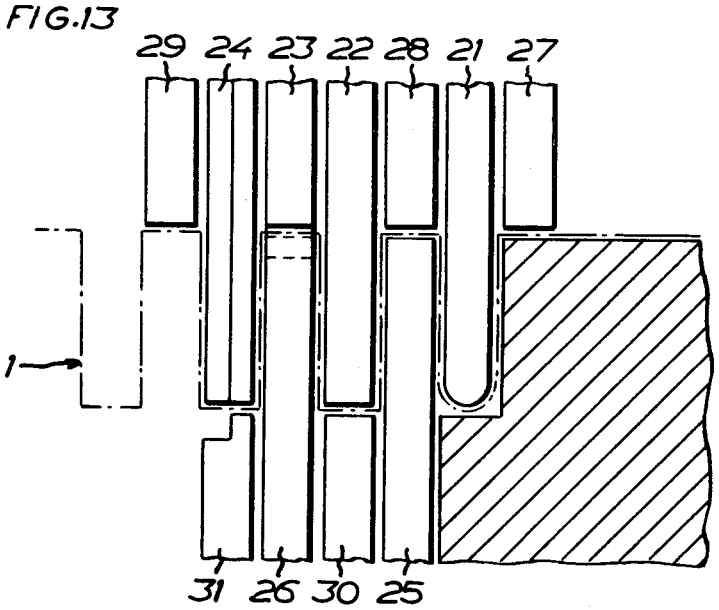

In the position illustrated in FIG. 10 all mandrels are moved out of the path of the corrugated metal sheet 1, by making it possible to advance the metal sheet by two mandrel widths. In the position illustrated in FIG. 11 the mandrels 22, 24, 25 and 26 have been entered some distance into the corrugations of the metal sheet 1 so that the continued advance of the sheet is impeded. In the position illustrated in FIG. 12 the mandrels 22, 24, 25 and 26 occupy the bottom positions in the corrugations so that the latter are given their final shape. In the position illustrated in FIG. 13 the mandrel 23 has been moved into engagement with the mandrel 26. The mandrel 23 being convex and the mandrel 26 concave, they shape the edge flange 5 between them. In the position illustrated in FIG. 13 the mandrel 21 too has taken the position in which it has been entered to the bottom of the corrugation, implying that it has subjected another corrugation to prefliminary shaping. From the position illustrated in FIG. 13 the mandrels revert to the positions in which they are distant from the metal sheet 1 so that the strip or band of sheet matal can again be advanced by two mandrel widths to the position illustrated in FIG. 10 for repetition of the working cycle described.

When the corrugated metal sheet 1 has been given the desired length the parts of the mandrel 24 are displaced so that said mandrel 24 in cooperation with the detail 31 cuts off the metal sheet 1, which is meant to be illustrated by FIG. 14.

The corrugated metal sheets 1 thus cut to length are then transported on the conveyors 10 to the riveting machine 11. Here a favourable heat transmitting contact is established between the recesses 3 in the metal sheets 1 and the tubes 2 of the space heater, the opposing metal sheets 1 being riveted to each other preferably by means of their own stock. The recesses 3 surround the tubes 2 over an arc of 180°. In other cases a juncture may be realized over an angle of less than 180°.

The metal sheet 1 preferably is a thin aluminum sheet but use may of course also be made of another material.

While the invention has been described above with reference to the embodiment illustrated in the drawings, modifications may be resorted to within the spirit and scope of the appended claims. Thus, for instance the corrugation crests on the two sides of the metal sheets may be provided with recesses for permitting said crests to bear against tubing.

What we claim and desire to secure by Letters Patent is:

1. A sheet metal heat transfer member for providing air channels in a heating system or the like comprising a series of corrugations and one or more rows of recesses formed therein, each of said rows of recesses being for engagement with a tube, each of said corrugations having a first side, a crest, and a second side, each of said recesses having edges located in one of said first sides, one of said crests, and one of said second sides for establishing heat transmitting contact between said member and a tube to be assembled thereon.

2. A sheet metal heat transfer member for use in combination with a tube to be assembled thereon, wherein said sheet metal heat transfer member is adapted to provide air channels in a heating system and comprises a series of corrugations and one or more rows of recesses formed therein, each of said rows of recesses being for engagement with a tube, each of said corrugations having a first side, a crest, and a second side, each of said recesses having edges located in one of said first sides, one of said crests, and one of said second sides for establishing heat transmitting contact between said member and a tube to be assembled thereon, each of said recesses is initially so much smaller than the geometrical figure that would be inscribed by the line of engagement between said member and the tube to be assembled thereon that an annular edge portion is formed between each of said recesses and the line of engagement so that said recesses will bear along the entire extent thereof against the tube so that excess material at the edges of the recesses form edge flanges facing the tube.

3. A sheet metal heat transfer member for forming air channels in a heating system comprising a series of corrugations and at least one or two rows of recesses having been punched in the sheet metal before corrugation thereof, said recesses being formed therein for engagement with a tube, each of said corrugations having a first side, a crest, and a second side, each of said recesses having edges located in one of said first sides, one of said crests, and one of said second sides for establishing heat transmitting contact between said member and a tube to be assembled thereon with each of said one or two rows of recesses being provided to accommodate the tube to be assembled thereon, and wherein each of said recesses is initially so much smaller than the geometrical figure inscribed by the line of engagement between said member and the tube to be assembled thereon that an annular edge portion is formed between each of said recesses and the line of engagement so that said recesses will bear along the entire extent thereof against the tube and so that excess material at the edges of the recesses form edge flanges facing the tube.

* * * * *